United States Patent [19]

Stadler

[11] Patent Number: 4,747,374

[45] Date of Patent: May 31, 1988

[54] COOLING AIR ARRANGEMENT FOR AIR-COOLED INTERNAL COMBUSTION ENGINE

[76] Inventor: Hans Stadler, Burgstrasse 28, 5060 Bergisch Gladbach 1, Fed. Rep. of Germany

[21] Appl. No.: 930,140

[22] Filed: Nov. 12, 1986

[30] Foreign Application Priority Data

Nov. 15, 1985 [DE] Fed. Rep. of Germany ..... 3540489

[51] Int. Cl.[4] ..... F01P 7/02

[52] U.S. Cl. ..... 123/41.6; 123/41.69

[58] Field of Search ..... 123/41.67, 41.7, 41.58, 123/41.6, 41.69

[56] References Cited

U.S. PATENT DOCUMENTS

| | | | |
|---|---|---|---|
| 1,683,602 | 9/1928 | Brockway | 123/41.6 |
| 2,289,959 | 7/1942 | Gregory | 123/41.7 |
| 4,222,360 | 9/1980 | Fujikawa et al. | 123/41.69 |

FOREIGN PATENT DOCUMENTS

| | | | |
|---|---|---|---|
| 504329 | 7/1954 | Canada | 123/41.6 |
| 917119 | 12/1946 | France | 123/41.69 |

*Primary Examiner*—Tony M. Argenbright
*Assistant Examiner*—Eric R. Carlberg

[57] ABSTRACT

An air-cooled internal combustion engine having a series of in-line cylinders with a cooling air blower adjacent an end cylinder. The blower delivers a stream of cooling air in the longitudinal direction of the engine which is redirected by air guide means laterally across the cylinders. To facilitate locating the blower nearer to the longitudinal central plane of the engine, several laterally spaced cooling fin parts are formed on the head structure of the end cylinder in alignment with the direction of flow of the stream of cooling air from the blower so that the overlapping relationship between the end cylinder head structure and the cross section of the blower does not adversely impede the air stream from the blower.

20 Claims, 3 Drawing Sheets

COOLING AIR ARRANGEMENT FOR AIR-COOLED INTERNAL COMBUSTION ENGINE

TECHNICAL FIELD

This invention relates to an air-cooled internal combustion engine and more particularly to the provision of a blower and guide means for delivering cooling air to the engine.

PRIOR ART STATEMENT

An air-cooled internal combustion engine of the general type shown and described herein is shown in Federal Republic of Germany Pat. No. DE-PS 11 35 711. The blower generating the flow of cooling air is mounted next to the first or end cylinder in such a way that the inflowing stream of cooling air enters a cooling air conduit alongside the first cylinder. The cooling fins of the cylinder heads are arranged transverse to the longitudinal central plane of the engine and thus the cooling air flows across the series of cylinders (including the first cylinder) in a substantially transverse direction with respect to the longitudinal central plane of the engine. The lateral displacement of the blower with respect to the cylinder head structure of the in-line cylinders substantially determines the installation width of an air-cooled engine. This lateral displacement cannot be arbitrarily reduced because the laterally extending cooling fins of the first cylinder adjacent to the blower would then partially block the blower outlet and thus decrease efficiency.

OBJECTS AND BRIEF SUMMARY OF THE INVENTION

A main object of the invention is to provide a cooling air guide means or duct work in an air-cooled internal combustion engine which allows a minimum lateral displacement of the blower with respect to the longitudinal central plane of the engine thus permitting reduction in the installation width of the engine.

In an air-cooled internal combustion engine utilizing this invention, the blower delivering longitudinal air flow is positioned to overlap a portion of the head structure of the adjacent end cylinder thus reducing the installation width of the engine. In order to permit this position of the blower without adverse effect on blower efficiency, a novel cooling fin arrangement is provided for the cylinder head structure of the end cylinder. Vertical cooling fin parts are provided on the overlapping part of the end cylinder head structure which permit longitudinal movement of the air from the blower and facilitate its change to a lateral flow across the cylinder head structure. These cooling fin parts may extend longitudinally in the direction of the air flow delivered by the blower, which is substantially parallel to the central longitudinal vertical plane through the axes of the in-line cylinders of the engine.

Since the cooling parts in the area of overlap of the blower and the cylinder head structure of the end cylinder extend in the direction of flow of the inflowing stream of cooling air, obstruction of the inflowing cooling air is substantially avoided. The cooling fin parts may be structurally designed to facilitate changing the direction of the incoming air from longitudinal to the crosswise or transverse direction of the laterally extending cooling fins on the other part of the cylinder head structure. This invention reduces the installation length and width of an air-cooled engine.

BRIEF DESCRIPTION OF THE DRAWINGS

Several embodiments of the invention are illustrated in the drawings, in which.

DETAILED DESCRIPTION OF THE DRAWINGS

Figure 1:
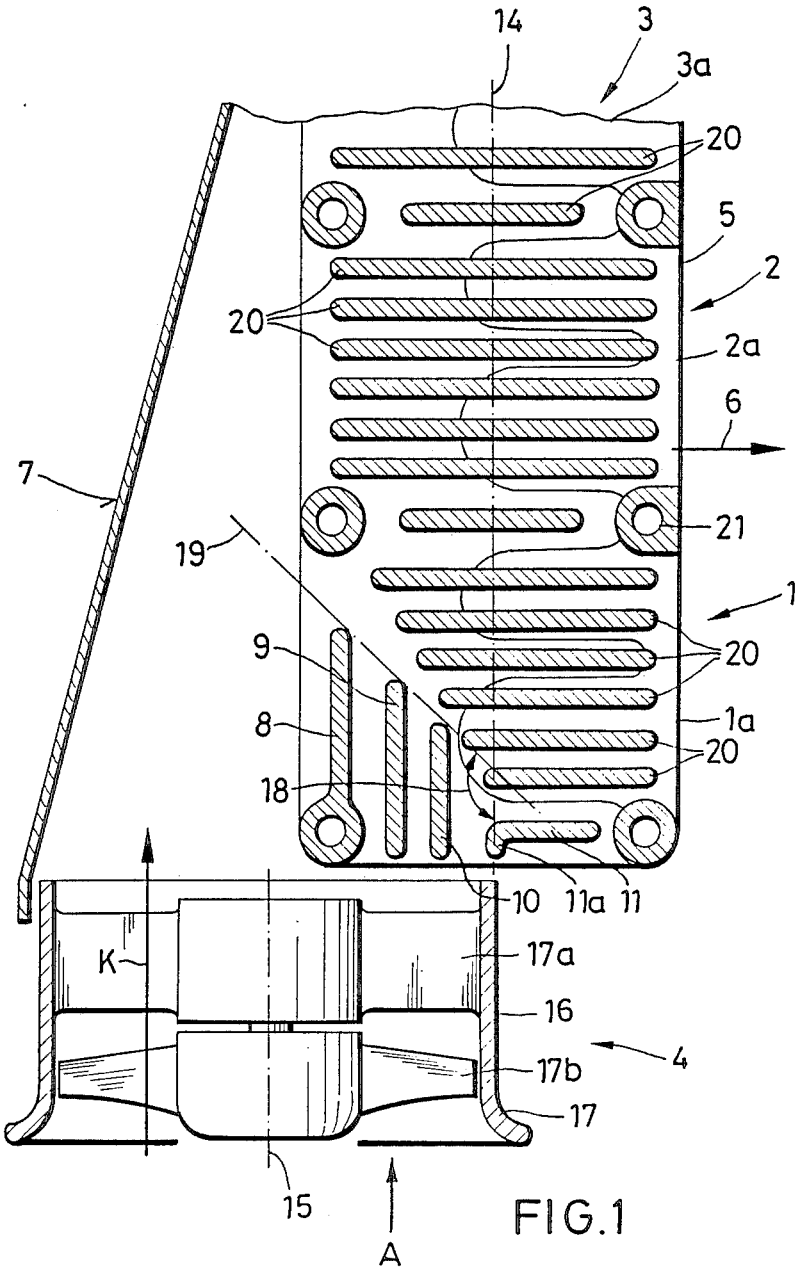
FIG. 1 is a partial view taken along the line I—I in FIG. 2 and which shows a blower and cooling fins of an engine incorporating one embodiment of the invention.
Figure 2:
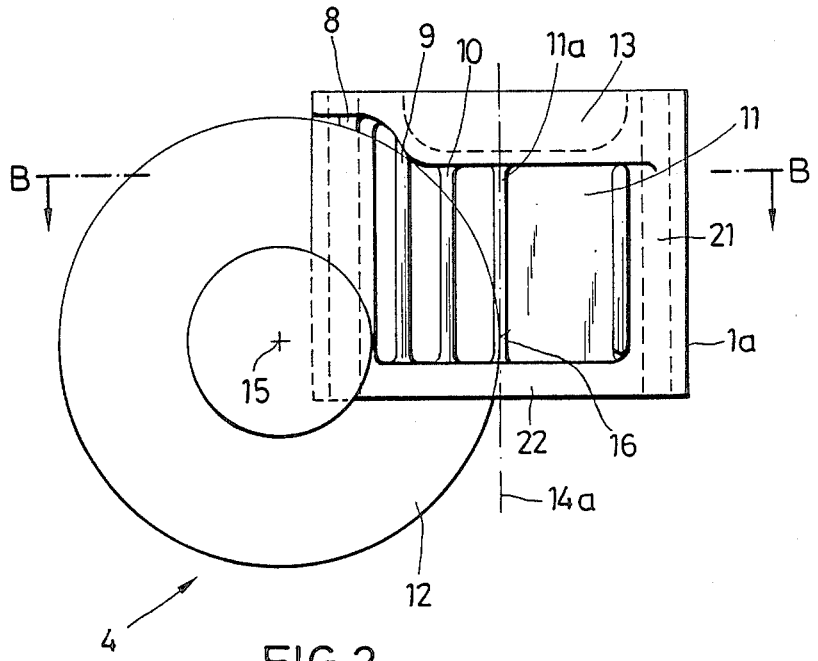
FIG. 2 is a partial end view of the engine of FIG. 1 as viewed in the direction of the arrow A.

FIG. 1 shows several in-line cylinders 1, 2, 3 arranged in series behind one another which support a block cylinder head. The block cylinder head is fastened by means of tension bolts which extend through the openings 21 and are screwed into the engine casing, not shown. An axial blower 4 for delivering cooling air is mounted adjacent the end cylinder 1 of the engine 5 and its axis 15 extends in the longitudinal direction of the engine 5. The blower 4 has a casing cover 17 in which a stationary guide wheel **17*a* has been arranged which supports the hub of the blower wheel or impeller 17*b* on the axis 15. The blower 4 generates a stream of cooling air, represented by the arrow K, which is substantially parallel to a longitudinal line or axis 14 extending through the axes of the cylinders 1, 2, 3. A cooling air conduit 7 is connected to the blower 4 which is positioned in front of the end cylinder 1 of the engine 5. Upon entering the conduit 7 alongside the engine, the cooling air changes direction and flows substantially laterally with respect to the engine, exiting in the direction of arrow 6. The laterally extending and vertical cooling fins 20 of cylinder head structures 1*a*, 2*a*, 3*a* extend in the direction of air flow indicated by the arrow 6 and are substantially at right angles to longitudinal center axis 14**.

In order to reduce the installation length as well as the installation width of the air-cooled engine, the blower 4 is arranged in such a way that its longitudinally extending axis 15 is parallel to the longitudinal center axis 14 of the engine 5, whereby an external casing edge 16 of the casing covering 17 is located in the longitudinal center plane **14*a* of the engine 5. The circumference 12 defining the cross section of the axial blower 4 at the front of the engine partially overlaps (seen in the direction of the arrow A) with the first or end cylinder 1, or more specifically its cylinder head structure 1*a*. Special laterally spaced cooling fin parts 8, 9, 10 of the cylinder head structure 1*a* are located in the area of overlap with blower 4 and they extend longitudinally in the direction of flow of the inflowing stream of cooling air indicated by the arrow K. Preferably the vertical fin parts 8, 9, 10 are parallel to the longitudinal center axis 14 of the engine 5. It will be noted that the laterally outermost cooling fin part 8 is the longest, while cooling fin parts 9, 10, which are located between cooling fin 8 and longitudinal center axis 14, have been designed with lengths which decrease in size the nearer they are to the longitudinal center axis 14. It is advantageous for the downstream ends of cooling fin parts 8, 9, 10 remote from the blower to terminate in approximately a straight line, represented by broken line 19, which, together with longitudinal center axis 14, forms an obtuse angle which opens toward the blower 4**.

As shown in FIG. 1, the cooling fin parts 8, 9, 10 are distributed over approximately one-fourth of the surface of cylinder head structure 1*a* and extend longitudinally in the direction of the inflowing cooling air, which is parallel to the longitudinal central plane 14*a*, while the longitudinally spaced upright cooling fins 20 are distributed over the remaining surface of cylinder head structure 1*a* and extend transverse to the direction of the stream of cooling air represented by the arrow K. In other words, the fins 20 extend at right angles to the axis 14 and the central plane 14*a*.

In the drawings only the end cylinder head structure 1*a* has cooling fin parts 8, 9, 10 oriented in the direction of flow of the inflowing cooling air. It may be advantageous to also provide the subsequent cylinder heads with one or more cooling fin parts, which are arranged in the longitudinal direction of the cylinder head series.

In accordance with FIG. 1, the cooling fin parts 8, 9, 10 are separated from cooling fins 20, which extend laterally with respect to longitudinal center axis 14. The separation can be provided in such a way that a channel is formed between the fin parts extending in the longitudinal direction and those fins extending in a crosswise direction.

Figure 3:
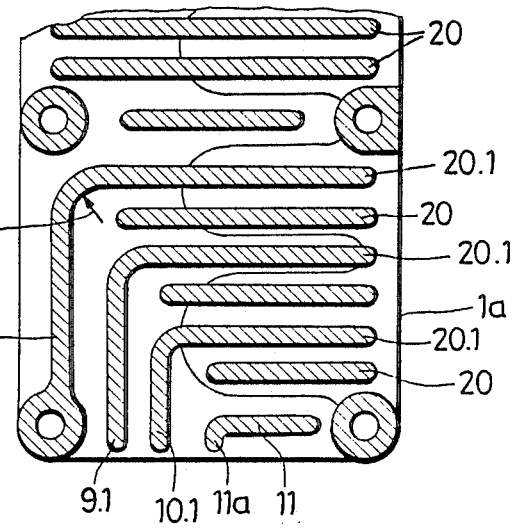
FIG. 3 is a view similar to FIG. 1 but showing a second embodiment of the invention.
Figure 4:
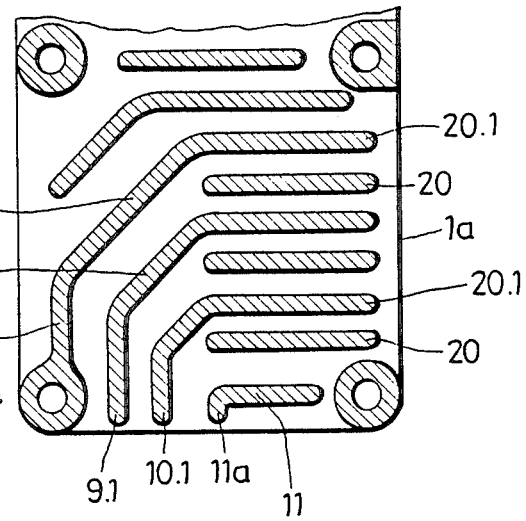
FIG. 4 is a view similar to FIG. 3 but showing a third embodiment of the invention.

As shown in FIGS. 3 and 4, a low resistance change of direction to the cooling air can be provided by designing several or all-cooling fin parts 8.1, 9.1, 10.1 in such a way that they each cross over into a laterally extending cooling fin 20.1. The transition portions joining the fin parts and fins are designed with a large transition radii R, which contribute to low resistance air deflection. In the FIG. 4 embodiment, the change of direction of the cooling air from the cooling fin parts 8.1, 9.1, 10.1 parallel to the longitudinal center axis 14 to corresponding cooling fins 20.1 extending at right angles to the longitudinal center axis 14 is achieved by use of intermediate angled fin segments 30. In this embodiment, cooling air fin parts 8.1, 9.1, 10.1 and fins 20.1 are designed to be shorter, this being permitted by the fin segments 30. Fin segments 30 extend at an angle of approximately 45 degrees with respect to the longitudinal center axis or plane of the engine.

The major portion of the front cooling fin 11 of cylinder head structure 1*a* is tranverse to the central vertical plane 14*a* of the engine. The fin 11 is L-shaped when viewed from above and has a smaller leg 11*a* adjacent the blower and located in the plane 14*a* of the longitudinal center axis 14 of the engine 5.

The laterally extending cooling fins 20 as well as the longitudinally extending cooling fin parts 8, 9, 10 and 11*a* are designed as structural support elements between the cylinder connected to the base of the combustion chamber portion 22 and the valve and/or cam shaft box 13 at the top of the cylinder head 1.

The embodiments of the invention in which an exclusive property or privilege is claimed are defined as follows:

1. In an air-cooled internal combustion engine having a plurality of in-line cylinders, a cylinder head structure on top of the cylinders including laterally extending upright cooling fins, a blower adjacent an end cylinder of the engine operable to deliver a stream of cooling air which flows in a longitudinal direction relative to the in-line cylinders and a part of which strikes said cylinder head structure of said end cylinder, and air guide means for diverting a portion of said longitudinal stream of cooling air to lateral flow across said head structure including generally longitudinally extending cooling fin parts on the portion of said cylinder head structure above said end cylinder which is struck by said stream of air delivered by said blower.

2. The internal combustion engine of claim 1 wherein said cooling fin parts are aligned generally parallel to the longitudinal central plane of the engine defined by the axes of said cylinders.

3. The internal combustion engine of claim 1 wherein said blower is an axial blower and its cross section overlaps said cylinder head structure of said end cylinder.

4. The internal combustion engine of claim 1 wherein said blower is an axial blower whose axis is parallel to the longitudinal plane of the engine defined by the axes of said cylinders and wherein said blower includes a casing having an outer edge portion approximately aligned with said central plane of said engine.

5. The internal combustion engine of claim 1 wherein the downstream ends of said cooling fin parts terminate in a straight line which with said longitudinal central plane define an obtuse angle which is open toward said blower.

6. The internal combustion engine of claim 5 wherein the laterally outermost cooling fin part extends longitudinally a greater distance than do the other cooling fin parts.

7. The internal combustion engine of claim 1 wherein the endmost cooling fin on said cylinder head structure of said one cylinder is L-shaped when viewed from above with its smaller leg aligned with said longitudinal central plane and its larger leg extending transverse to said longitudinal central plane.

8. The internal combustion engine of claim 1 wherein at least two of said cooling fin parts overlap ends of laterally extending cooling fins on said head structure on said end cylinder whereby a low resistance transition of the cooling airflow is afforded.

9. The internal combustion engine of claim 8 wherein said fin parts are connected, respectively, to said cooling fins on said head structure of said end cylinder.

10. The internal combustion engine of claim 9 wherein said blower is an axial blower disposed in overlapping relation to said cylinder head structure of said end cylinder.

11. The internal combustion engine of claim 8 wherein said fin parts are connected, respectively, to every other one of said cooling fins.

12. The internal combustion engine of claim 1 wherein at least two of said fin parts are connected, respectively, to a pair of said diagonally extending cooling fins on said head structure on said end cylinder.

13. The internal combustion engine of claim 1 wherein said fin parts are laterally spaced from one another and parallel to said direction of flow of the inflowing stream of cooling air delivered by said blower.

14. The internal combustion engine of claim 13 wherein said blower is an axial blower whose cross section partially overlaps said cylinder head structure of said end cylinder.

15. In an air-cooled internal combustion engine having a plurality of in-line cylinders with cylinder head structure including laterally extending cooling fins, a blower adjacent an end cylinder of the engine operable to deliver a stream of cooling air which flows in a longitudinal direction relative to the in-line cylinders and a part of which strikes said cylinder head structure of said end cylinder, and air guide means for diverting a portion of said longitudinal stream of cooling air to lateral flow across said head structure including generally longitudinally extending cooling fin parts on the portion of said cylinder head structure of said end cylinder which is struck by said stream of air delivered by said blower, said cooling fin parts being aligned generally parallel to the longitudinal central plane of the engine defined by the axes of said cylinders.

16. In an air-cooled internal combustion engine having a plurality of in-line cylinders with cylinder head structure including laterally extending cooling fins, a blower adjacent an end cylinder of the engine operable to deliver a stream of cooling air which flows in a longitudinal direction relative to the in-line cylinders and a part of which strikes said cylinder head structure of said end cylinder, and air guide means for diverting a portion of said longitudinal stream of cooling air to lateral flow across said head structure including generally longitudinally extending cooling fin parts on the portion of said cylinder head structure of said end cylinder which is struck by said stream of air delivered by said blower, the downstream ends of said cooling fin parts terminating in a straight line which with said longitudinal central plane define an obtuse angle which is open toward said blower.

17. The internal combustion engine of claim 16 wherein the laterally outermost cooling fin part extends longitudinally a greater distance than do the other cooling fin parts.

18. In an air-cooled internal combustion engine having a plurality of in-line cylinders with cylinder head structure including laterally extending cooling fins, a blower adjacent an end cylinder of the engine operable to deliver a stream of cooling air which flows in a longitudinal direction relative to the in-line cylinders and a part of which strikes said cylinder head structure of said end cylinder, and air guide means for diverting a portion of said longitudinal stream of cooling air to lateral flow across said head structure including generally longitudinally extending cooling fin parts on the portion of said cylinder head structure of said end cylinder which is struck by said stream of air delivered by said blower, said fin parts being connected, respectively, to said cooling fins on said head structure of said end cylinder.

19. The internal combustion engine of claim 18 wherein said fin parts are connected, respectively, to every other one of said cooling fins.

20. In an air-cooled internal combustion engine having a plurality of in-line cylinders with cylinder head structure including laterally extending cooling fins, a blower adjacent an end cylinder of the engine operable to deliver a stream of cooling air which flows in a longitudinal direction relative to the in-line cylinders and a part of which strikes said cylinder head structure of said end cylinder, and air guide means for diverting a portion of said longitudinal stream of cooling air to lateral flow across said head structure including generally longitudinally extending cooling fin parts on the portion of said cylinder head structure of said end cylinder which is struck by said stream of air delivered by said blower, said fin parts being laterally spaced from one another and parallel to said direction of flow of the inflowing stream of cooling air delivered by said blower.

* * * * *